United States Patent [19]

Williams

[11] Patent Number: 4,608,023

[45] Date of Patent: Aug. 26, 1986

[54] WATER SKI

[75] Inventor: Frederick W. Williams, Gateshead, Australia

[73] Assignee: Ski-Ace Pty. Limited, Sydney, Australia

[21] Appl. No.: 617,956

[22] Filed: Jun. 7, 1984

[30] Foreign Application Priority Data

Jul. 27, 1983 [AU] Australia ..... PG0506

[51] Int. Cl.[4] ..... A63C 15/00

[52] U.S. Cl. ..... 441/68; 441/79

[58] Field of Search ..... 441/68, 74, 79, 65; 114/62, 288, 290, 39.2, 56; D21/228–231

[56] References Cited

U.S. PATENT DOCUMENTS

| | | | |
|---|---|---|---|
| 3,027,575 | 4/1962 | Fortin | 441/68 |
| 3,099,025 | 7/1963 | Merkley et al. | 441/68 |
| 3,148,392 | 9/1964 | Bennett | 441/68 |
| 3,201,807 | 8/1965 | Weaver | 441/79 |
| 3,731,328 | 5/1973 | Russell | 441/70 |
| 3,827,096 | 8/1974 | Brownson | 441/68 |
| 4,193,369 | 3/1980 | Talamantes, Jr. | 114/62 |
| 4,314,384 | 2/1982 | Weinhaus | 441/68 |

*Primary Examiner*—Trygve M. Blix
*Assistant Examiner*—Edwin L. Swinehart
*Attorney, Agent, or Firm*—Poms, Smith, Lande & Rose

[57] ABSTRACT

A water ski of conventional form so far as general contour and leading end uptilt is concerned, has two tunnels or grooves formed in its underface and a fin in each tunnel which projects downwardly from the trailing end portion of its tunnel. The tunnels:

1. are arcuate in cross-section,
2. begin in a point short of the leading edge of said underface and end at the trailing end of said underface, and
3. at said point are of zero width and depth and, proceeding to said trailing end, progressively increase in both of these lateral directions.

9 Claims, 8 Drawing Figures

WATER SKI

BACKGROUND OF THE INVENTION

This invention relates to the field of water skis.

One of the shortcomings of existing water skis is the difficulty in maintaining stability, particularly when following a curved path. Stability is impaired whenever the ski side slips relative to the water or when the direction in which it is moving angularly departs, even slightly, from the direction in which its own longitudinal axis is pointing.

The object of this invention is to remedy, or at least ameliorate, the shortcoming referred to above; by relatively simple modification of a water ski whereby it more effectively "takes hold" of the water in relation to which it is moving.

SUMMARY OF THE INVENTION

In summary, the invention provides a water ski characterised in that:

(a) the underface of the ski has a pair of similar grooves or "tunnels" formed in it and extending from the trailing end of said underface to a point in that underface ahead of the mid-point of its length but short of its leading end, (b) said tunnels are arcuate concavities whereof the breadth and depth progressively increase in the direction towards said trailing end, and (c) two blade-like fins fixed relatively to said underface extend substantially longitudinally thereof and respectively from the trailing end portions of said tunnels.

An example of the invention is illustrated in the drawings herewith.

DESCRIPTION OF THE PREFERRED EMBODIMENT

Figure 1:
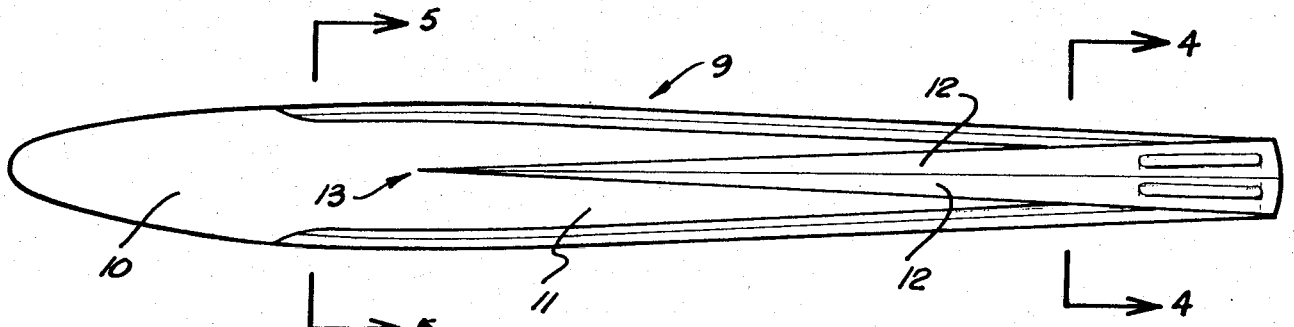
FIG. 1 is an inverted plan of a water ski.
Figure 2:
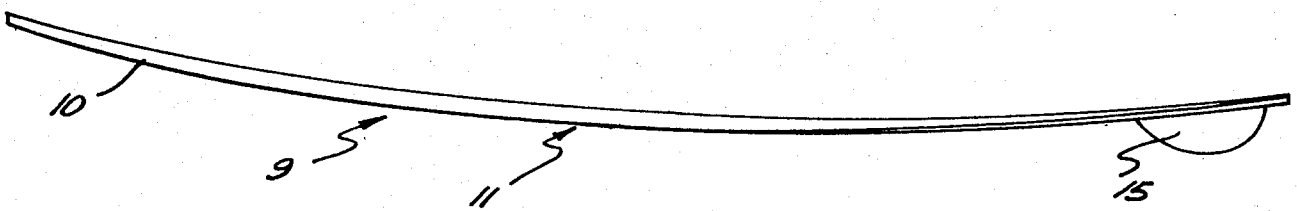
FIG. 2 is a side elevation projected from FIG. 1.
Figure 3:
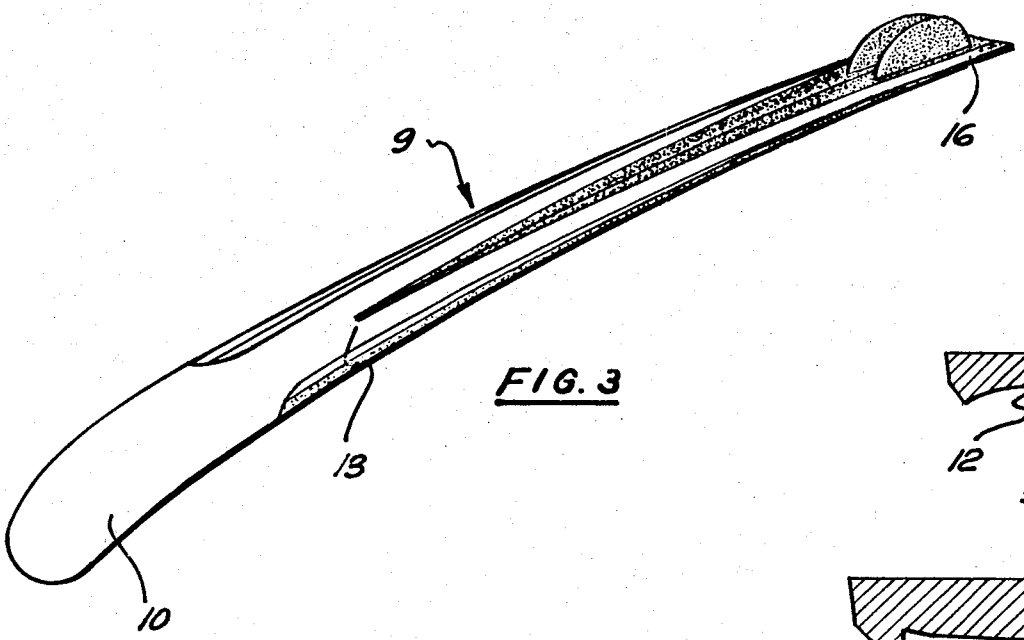
FIG. 3 is an underside perspective.
Figure 4:
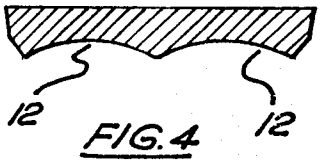
FIGS. 4 and 5 are cross-sections respectively taken (but on an enlarged scale) on lines 4—4 and 5—5 in FIG. 1.
Figure 5:
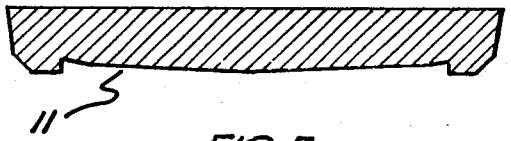

Referring to the drawings the water ski 9 is of conventional form insofar as its general contour and the uptilt of its leading end portion 10 are concerned. Its underface 11 has two grooves or tunnels 12 formed therein. These tunnels are arcuate in cross-section as shown in FIG. 4. They extend from a point 13, which is about one third of the underface length from the leading end, to the trailing end 14. They start, at point 13, as of zero width and depth, and proceeding to the trailing end, progressively increase in both lateral directions.

Each of the tunnels has a fin 15 projecting from its trailing end 16. These fins are preferably placed with their longitudinal centre-lines co-incident with those of the tunnels from which they project; thus they are slightly divergent in the direction towards trailing end 16.

Each of the fins 15 is fixed to the body of the ski in any convenient manner. In the illustrated arrangement each fin consists of a blade 17 which projects through a slot 18 in the body of the ski, and a fixing flange 19 by which the fin is secured in position, for example, by screws indicated at 20 in FIG. 7.

Figure 7:
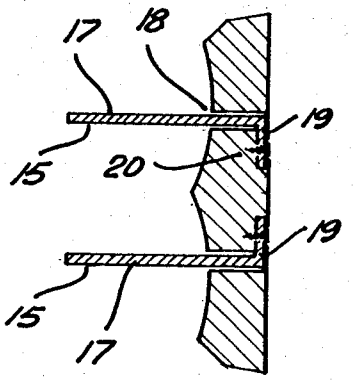
FIGS. 7 and 8 are sections on lines 7—7 and 8—8 in FIG. 6 but with fins included.
Figure 6:
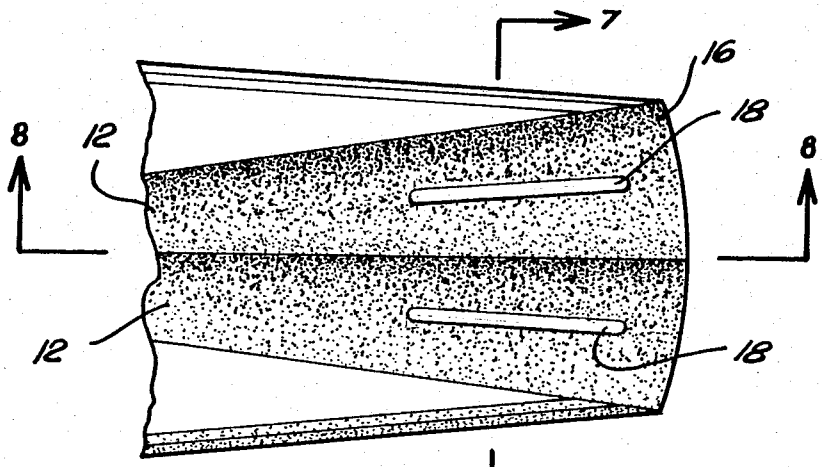
FIG. 6 is a fragmentary plan, on an enlarged scale, of the trailing end portion of the ski with fins omitted.
Figure 8:
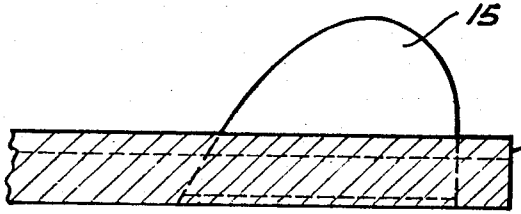

It will be seen from FIG. 7 that the fins 15 (although divergent in the longitudinal sense as indicated by slots 18 in FIG. 6) may be sectionally parallel in the lateral sense as shown in FIG. 7. On the other hand, the fins may be bent or moulded so as to be not sectionally parallel as shown in FIG. 7. This may be necessary to suit the requirements of a specific user of the ski. In this connection it will be appreciated that a ski-user may have a tendancy to "side-slip" to one side rather than the other and this, we have found, can be countered, at least to some extent, by lateral (inward or outward) bending or setting of one fin relative to the other.

I claim:

1. A water ski characterized in that:

(a) the underface of the ski has a pair of similar grooves or "tunnels " formed in it and extending from the trailing end of said underface to a point in that underface ahead of the mid-point of its length but short of its leading end;

(b) said tunnels are arcuate concavities whereof the breadth and depth progressively increase in the direction towards said trailing end;

(c) two blade-like fins fixed relatively to said underface extend substantially longitudinally thereof and respectively from the trailing end portions of said tunnels;

(d) each of said tunnels being arcuate over substantially its full transverse extent, and each of said tunnels extending substantially half of the way across said trailing end of said water ski; and (e) said point being a single point located substantially half way across said ski, and the outer edges of both of said grooves or tunnels converging substantially to said single point.

2. A water ski according to claim 1 wherein said tunnels extend to the trailing end of said underface from a point in that underface located from the leading end thereof by a distance substantially equal to one third of the length of said underface.

3. A water ski as defined in claim 1 wherein said fins have their longitudinal center lines substantially coincident, respectively, with the center lines of said grooves or "tunnels".

4. A water ski as defined in claim 1 wherein each of said fins includes a blade which projects through a slot in the ski, and a fixing flange extending transversely from said blade at the opposite end of said fin from said blade, and means for securing said flange to the face of said ski on the side thereof opposite to said underface.

5. A water ski as defined in claim 2 wherein said fins have their longitudinal center lines substantially coincident, respectively, with the center lines of said grooves or "tunnels".

6. A water ski as defined in claim 2 wherein each of said fins includes a blade which projects through a slot in the ski, and a fixing flange extending transversely from said blade at the opposite end of said fin from said blade, and means for securing said flange to the face of said ski on the side thereof opposite to said underface.

7. A water ski as defined in claim 5 wherein each of said fins includes a blade which projects through a slot in the ski, and a fixing flange extending transversely from said blade at the opposite end of said fin from said blade, and means for securing said flange to the face of said ski on the side thereof opposite to said underface.

8. A water ski characterised in that:

(a) the underface of the ski has a pair of similar grooves or "tunnels" formed in it and extending from the trailing end of said underface to a single point in that underface ahead of the mid-point of its length but short of its leading end;

(b) said tunnels are arcuate concavities whereof the breadth and depth progressively increase in the direction towards said trailing end;

(c) two blade-like fins fixed relatively to said underface extend substantially longitudinally thereof and respectively from the trailing end portions of said tunnels; and (d) said tunnels each extending substantially half of the way across said trailing end of the water ski, and the outer edges of both of said tunnels converging substantially to said single point.

9. A water ski comprising an elongated relatively thin member slightly curved from end to end with the underface of the ski being convex, characterized in that:

(a) the underface of the ski has a pair of similar grooves or "tunnels" formed in it and extending from the trailing end of said underface to a point in that underface ahead of the mid-point of its length but short of its leading end;

(b) said tunnels being arcuate concavities whereof the breadth and depth progressively increase in the direction toward said trailing end;

(c) two blade-like fins fixed relatively to said underface extending substantially longitudinally thereof and respectively from the trailing end portions of said tunnels;

(d) said tunnels extending to the trailing end of said underface from a point in that underface located from the leading end thereof by a distance substantially equal to one-third of the length of said underface;

(e) said fins having their longitudinal center-lines substantially coincident with those of said tunnels;

(f) each of said fins being composed of a blade which projects through a slot in the ski and a fixing flange extending transversely to said blade on the side of said ski opposite to said underface;

(g) means for securing said fixing flange to the face of said ski opposite to said underface;

(h) each of said tunnels being arcuate over substantially its full transverse extent, and each of said tunnels extending substantially half of the way across said trailing end of said water ski; and (i) said point being a single point located substantially half way across said ski, and the outer edges of both of said grooves or tunnels converging substantially to said single point.

* * * * *